US007000544B2

(12) United States Patent
Riepenhoff

(10) Patent No.: US 7,000,544 B2
(45) Date of Patent: Feb. 21, 2006

(54) MEASUREMENT AND REGULATION OF INKING IN WEB PRINTING

(75) Inventor: Matthias Riepenhoff, Bern (DE)

(73) Assignee: Maschinenfabrik WIFAG, Bern (CH)

( * ) Notice: Subject to any disclaimer, the term of this patent is extended or adjusted under 35 U.S.C. 154(b) by 147 days.

(21) Appl. No.: 10/186,590

(22) Filed: Jul. 1, 2002

(65) Prior Publication Data

US 2003/0005841 A1 Jan. 9, 2003

(30) Foreign Application Priority Data

Jul. 2, 2001 (DE) ..... P 101 31 934

(51) Int. Cl.
*B41F 1/54* (2006.01)

(52) U.S. Cl. ..... 101/484; 101/356; 356/402

(58) Field of Classification Search ..... 101/483–485, 101/335, 385, 349.1, 350.1; 356/402–407
See application file for complete search history.

(56) References Cited

U.S. PATENT DOCUMENTS

| | | | | |
|---|---|---|---|---|
| 4,197,584 A | | 4/1980 | Blazek | 356/394 |
| 4,390,958 A | | 6/1983 | Mamberer | 101/350.1 |
| 5,543,922 A | * | 8/1996 | Runyan et al. | 356/402 |
| 5,774,225 A | * | 6/1998 | Goldstein et al. | 356/402 |
| 5,781,823 A | * | 7/1998 | Isobe et al. | 399/2 |
| 5,927,201 A | * | 7/1999 | Birkenfeld et al. | 101/365 |
| 6,024,018 A | * | 2/2000 | Darel et al. | 101/365 |
| 6,230,622 B1 | * | 5/2001 | Dilling | 101/484 |

FOREIGN PATENT DOCUMENTS

| | | |
|---|---|---|
| CH | 283 071 | 6/1950 |
| DE | 29 37 128 A1 | 4/1980 |
| DE | 29 50 606 A1 | 6/1981 |
| DE | 42 37 004 A1 | 5/1994 |

* cited by examiner

*Primary Examiner*—Minh Chau
(74) *Attorney, Agent, or Firm*—McGlew and Tuttle, P.C.

(57) ABSTRACT

A process is provided for measuring the inking in web printing, wherein a measuring head or a plurality of measuring heads performs/perform an integrating measurement of the light remitted from a printed web of material in the direction of run of the web of material. A device is also provided for measuring the inking in web printing. The device includes at least one sensor element for receiving light, which is remitted by a running, printed web of material, an adding or integrating device, which is connected to a sensor element, of which there is at least one, in order to determine the intensity of the light received and a control, which presets the duration of reception of light and/or the duration of the addition or integration by means of the adding or integrating means for an adding or integrating intensity measurement of the remitted light in the direction of run of the web.

22 Claims, 3 Drawing Sheets

MEASUREMENT AND REGULATION OF INKING IN WEB PRINTING

FIELD OF THE INVENTION

The present invention pertains to a process for measuring the inking during printing, in which integral measurements are carried out on the running paper web. The present invention also pertains to a device for carrying out the process. Furthermore, the present invention pertains to the regulation of the inking in web-printing presses. The present invention also pertains to a device for carrying out the process.

BACKGROUND OF THE INVENTION

Newspapers are produced predominantly according to the offset process. A plurality of paper webs are unwound from rolls, printed in the printing units and finally folded in the folding apparatus and cut. The inking can be set zone by zone in conventional inking systems. The presetting of the inking systems is based on the surface coverage of the printing plates, which is determined by means of so-called plate scanners, or can be calculated directly from the image data. The printer monitors the inking during the entire production and makes corrections in inking when necessary.

WO 96/12934 of Graphics Microsystems Inc., discloses a process for measuring the inking. In this or similar processes, a measuring element is recognized using video cameras and subjected to spectral measurement. The drawback of these processes is, first, the great technical effort and, second, the need to jointly print measuring elements on the web, which are subsequently cut off. The format of a newspaper is usually not trimmed, and it is therefore, in general, undesired to print measuring elements jointly. Therefore, such measurement processes or automatic ink regulating systems based on such processes have not yet been used in newspaper printing.

Another basic difficulty for the automatic regulation of inking arises from the complex dynamics of the conventional gap inking systems. For example, the inking must always be set zone by zone, the delay time with which an adjustment of the inking becomes effective on the printed web depends strongly on the ink take-off, and, moreover, the inking is affected in adjacent zones.

The production of printing plates is carried out in newspaper printing in the so-called preliminary printing stage. To do so, the original prepared in the editorial office of the newspaper is typically separated into four printing colors cyan, magenta, yellow and black. The color separations are reduced to half-tones after the separation, and pixel data, which represent the elements to be printed on the printing plate, which are exposed on the basis of these data, are obtained as a result.

Three-dimensional tristimulus values are transformed during the color separation into the four-dimensional color space C, M. Y, K. Depending on the type of separation, superimposed chromatic colors can be replaced to a certain extent or completely by black color. The type of separation should be known for corrections of the inking.

Changes also arise in the color effect of a paper web printed according to the web offset process when the amount of moisture fed in is changed. In fact, the establishment of a so-called ink-water balance requires a certain amount of experience in practice. Moreover, it depends on the type of paper and the printing style.

The visual evaluation of the color in the print is carried out in the three-dimensional color space, which corresponds to the human eye. On the other hand, there is a large number of adjusting possibilities to affect the color reproduction. As a result, the automatic regulation of the inking is made more difficult.

DE 198 22 662 A1 of MAN Roland Druckmaschinen AG proposes a process for operating a printing press, in which basic knowledge is obtained on the cooperation of operating media in the printing press by printing tests or during the production, it is stored in an expert system and used for the printing operation. An expert system is a "computer program system which stores all the material available on a special area, draws conclusions from same, and proposes solutions for problems of the area in question. The structure of expert systems and their use falls within the area of artificial intelligence" (cf. LexiRom 4.0, Microsoft Corp., 1999). Such systems typically have a dialog component, an explanation component, a knowledge acquisition component, a problem solving component, and a knowledge base. Such a system is difficult to operate and maintain. Besides the personnel for operating the printing press, it requires specialists from the area of information processing. An expert system is also not a closed regulatory circuit, it does not replace the expert, but is a tool to support the expert in processing complex problems by proposing solutions. To reduce the errors in the printing process, the applicant of the above-mentioned disclosure document proposes to reduce the complexity of the printing press by using a short inking system.

SUMMARY OF THE INVENTION

One object of the present invention is to provide an inexpensive process for color measurement on the web, in which no measuring elements need to be printed jointly.

According to the invention, a process is provided for measuring the inking in web printing in which a measuring head or a plurality of measuring heads performs/perform an integrating measurement of the light remitted by a printed material web in the direction of run of the material web. Device is also provided for measuring the inking in web printing, preferably for carrying out the measurement process in accordance with the invention The device includes at least one sensor element for receiving light that is remitted by a running, printed web of material, an adding or integrating means, which is connected to a sensor element, of which there is at least one, in order to determine the intensity of the light received, and a control, which presets the duration of reception of light and/or the duration of the addition or integration by means of the adding or integrating means for an adding or integrating intensity measurement of the remitted light in the direction of run of the web.

Furthermore, another subject of the present invention is a process for the rapid regulation of the inking of a gap printing system. According to this aspect of the invention, actual values are generated by a process discussed above. Set points are calculated from the image data, forming integrals of the remission spectrum over the columns of the image and folding these with the measuring field function of a measuring head, or set points are formed from the measured actual values of pages that are considered to be good. The ink density is set by setting the ink feed or the damping agent feed. A device for regulating the ink density in web printing, preferably for carrying out the regulating process in accordance with one of the above claims, characterized in that set points are calculated from the image data.

The basic idea of the present invention is based on the fact that the inking of a printing press with gap inking system takes place zone by zone. One zone always corresponds to one strip of the printed image in the direction of the press. This circumstance is taken into account in the process according to the present invention insofar as an integral measurement of the colors on the web is carried out over a longitudinal strip. Whether a spectral color measurement or a densitometric measurement or another principle of measurement is used to evaluate the printed web is basically irrelevant.

Each measurement process for evaluating the optical effect of a surface is based on the fact that the radiation remitted from the surface is received by a measuring apparatus, in which the incident light is integrated. For example, free charges are produced in a fiber-optic light guide in electronic detectors in proportion to the effect of the light, unless the working range of the apparatus is exceeded. In the case of densitometric measurement, the incident light is separated by color filters before it is detected by photosensitive detectors. In the case of spectral measurement, the dispersion of a prism or a grid is utilized to image the components of different wavelengths onto a photosensitive semiconductor array in a locally resolved manner. The amount of incident light is integrated in the individual cells until saturation is reached.

If it is desirable to measure the optical effect of the surface of a moving object at a certain point, it is possible, e.g., to move the measuring head in relation to the object to be measured at equal velocity as long as the measuring operation lasts. It is usually simpler to use a flash lamp and thus send a large amount of radiation into the detector during the short duration of the flash. The integration times of the measuring apparatus are short in this case, so that the movement of the object during the measurement can be ignored.

In this case, the measured object is the running, printed web in a printing press. The image located thereon is repeated with the frequency of rotation of the printing cylinders. If a detector is placed in a fixed manner over the web, and the measurement is performed for the duration of one revolution of the cylinders, the radiation emitted from all locations along one strip in the direction of the press is integrated in the measuring head. The length of the strip corresponds to the revolution of the cylinder, and the width of the strip depends on the optical system of the detector. It is not absolutely necessary to image a sharp image strip into the detector. If the integral measurement of a periodic original is performed, as is the case in the case of the printing operation, over the duration of one period or over an integer multiple of the duration of the period, it is important to adjust the duration of the measurement to the duration of the period, the point in time at which the measurement begins being irrelevant in this case.

If the measurement is carried out over part of the duration of one period, e.g., over half of one period, it is necessary to know the point in time of the measurement.

Such an integral measurement can be advantageously broken down into a plurality of integral partial measurements following one another without delay and the results can be summed up.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
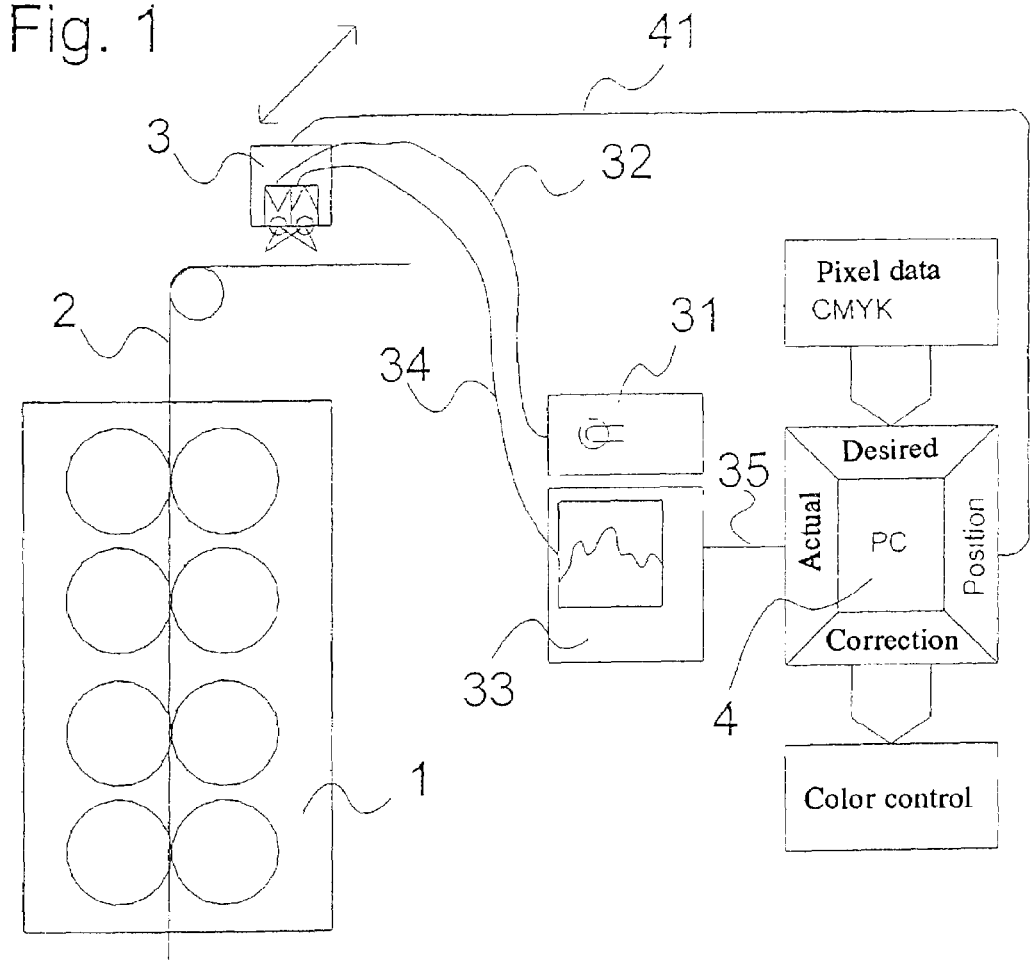
FIG. 1 is a schematic view of an arrangement for carrying out the process based on the example of a spectral measurement.

Referring to the drawings in particular, FIG. 1 shows a schematic arrangement for carrying out the process based on the example of a spectral measurement. The press 1 prints on a paper web 2. A measuring head 3 is placed over the web 2. The measuring head contains an illuminating means, which is connected to a light source 31 via a glass fiber line 32. The light reflected by the web 2 is introduced into a spectrometer 33 via a glass fiber line 34. The spectrometer is controlled by a computer 4 such that the measurements are adjusted to the speed of rotation. A measurement includes one or more partial measurements. The overall duration of the measurement is exactly the duration of one revolution of the cylinder or a multiple thereof As a result of the measurement, a spectrum is transmitted to the computer 4. This spectrum is the integral of all remission spectra that are measured at the locations on the paper web that pass under the measuring head during the measurement. The measuring head can be positioned by means of a displacing unit at right angles to the direction of the press, and the positioning is likewise controlled by the computer 4 by means of the control line 41.

Figure 2:
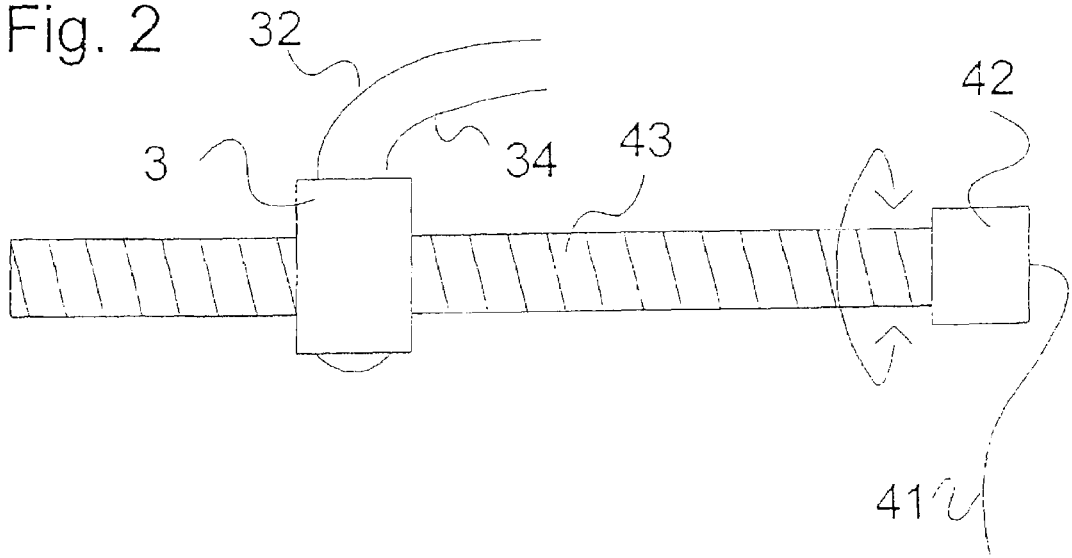
FIG. 2 is a schematic view showing a displacing unit in the X direction, at right angles to the direction of the press.

FIG. 2 shows a sketch of a displacing unit in the X direction, at right angles to the direction of the press. The measuring head 3 with the optical connections 32, 34 is mounted on a spindle 43. The spindle drive 42 is controlled via the line 41. The measuring head can thus be positioned at right angles to the direction of the press at any desired point over the paper web.

Figure 3A:
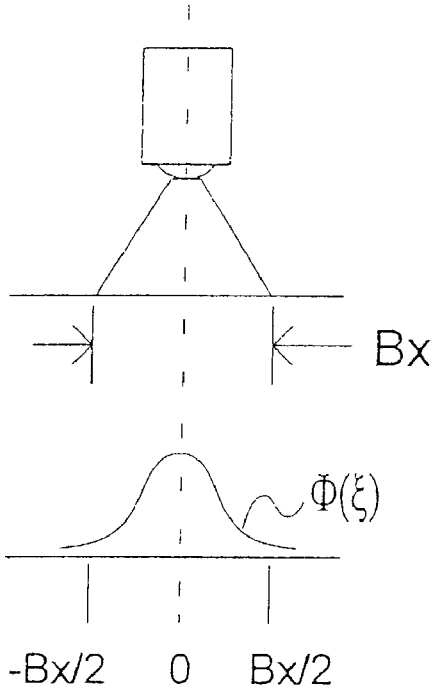
FIG. 3 is a view illustrating the local measuring behavior of a measuring head.
FIG. 3*b* is a view illustrating the problem of the measuring field function for the two-dimensional case.

FIG. 3*a* illustrates the local measuring behavior of a measuring head. In general, a measuring head detects a range of the width Bx. The optical effect of the object being measured in the detected range is not of equal intensity at all locations, and it can be weighted by a function $\Psi\xi$. $\Psi\xi$ depends on the nature of the measuring head and the distance between the measuring head and the object being measured. This function will hereinafter be called the measuring field function.

Figure 3B:
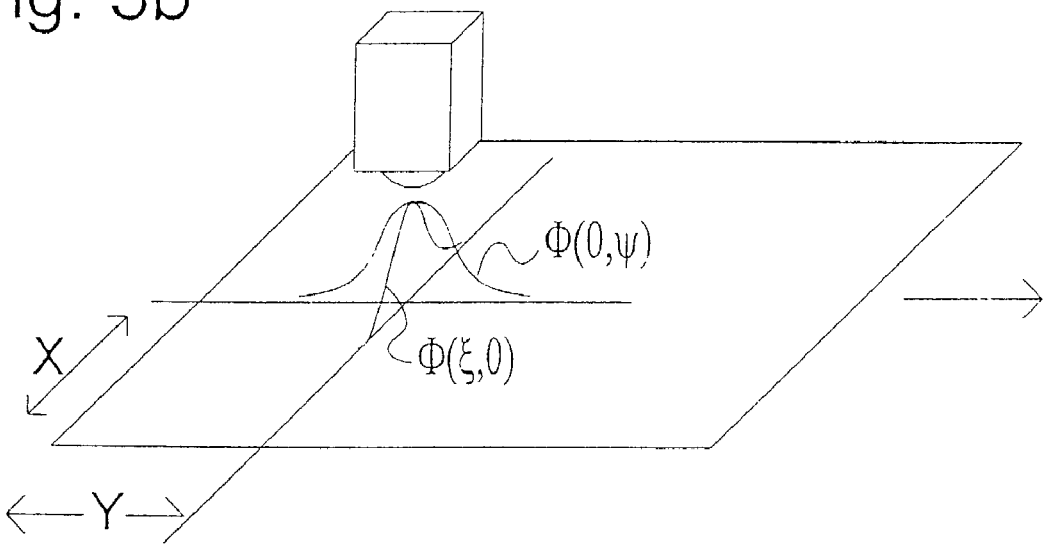

FIG. 3*b* illustrates the problem of the measuring field function for the two-dimensional case. The measuring field also has an extension in the Y direction, By, besides the extension in the X direction, Bx. Even though it is possible to design a measuring head by means of a suitable optical system such that the extension of the measuring field in the Y direction is restricted so greatly that this dimension of the measuring field function can be ignored, this is associated with increased technical effort or with a loss of sensitivity. A sharp limitation of the measuring field in the Y direction is not necessary for the process according to the present invention.

A remission spectrum is an intensity distribution as a function of the wavelength $\lambda$. If it is measured in a spectrometer that breaks down the spectral range into n intervals, a vector $r=[I(\lambda 1), I(\lambda 2), I(\lambda 3), \ldots I(\lambda n)]$ is obtained. The remission spectrum at the location X can be considered to be a vector rX.

The spectrum R recorded by a measuring head with the measuring field function $\Psi$ at the location X is obtained by integration:

$$R(X) = \int_{-Bx/2}^{Bx/2} r(X+\xi)\cdot\Phi(\xi)d\xi.$$

In the 2 or 3-dimensional case:

$$R(X, Y) = \int_{-Bx/2}^{Bx/2}\int_{-By/2}^{By/2} r(X+\xi, Y+\psi)\cdot\Phi(\xi, \psi)d\psi d\xi$$

The fact described here on the basis of the example of a spectral measurement can be applied to any color measurement process commonly used in the graphics industry. In the case of a densitometric measurement, the vector r has only 3 or 4 dimensions.

If the object being measured is moving during the measurement, a further integration must be performed in order to describe the result of the measurement. The longer the measuring head remains at the points located on the path traveled during the measurement, the greater is the contribution of these points to the measured value. A simple case is obtained during the measurement of the duration T with a measuring head that is positioned in a fixed position over a printed paper web that is running at constant velocity V in the direction Y under the measuring head. If the measurement begins at the time t0 and the measuring head is located at the point X0, Y0 at this point in time, is obtained.

$$R = \int_{t0}^{t0+T} R(X0, Y0+V(t-t0))dt.$$

A further simplification is obtained based on the periodicity of the printing operation. If the circumference of the printing cylinder is U, the remission spectra are repeated in the ideal case at this period, i.e., r(X,Y)=r(X,Y+U) in the direction of the press.

This periodicity can be applied to the measurement with one measuring head. R(X,Y)= R(X,Y+U) is obtained for each measuring field function.

Due to fact that the stretching of the paper changes during the run through the press, this relationship is not exact. However, a periodicity in time is obtained at constant speeds of rotation. Since the stretching of the web reaches steady states, the measurement over the duration of one revolution of the cylinder corresponds precisely to the measurement of one section length, even if the web is stretched. Measurement over a time T=U/V corresponds to the scanning of the web over one section length. Now, $$R = \int_{t0}^{t0+T} R(X0, Y0+V(t-t0))dt = \int_{0}^{U} R(X0, Y)dY.$$

Thus, an integral measurement depends only on the measuring field function of the measuring head, the lateral measuring position X and the spectral remission r(X,Y) of the printed image. It is, in particular, independent from the point in time at which the measurement begins.

Thus, such a process yields reproducible measured values, which are locally resolved in one dimension, namely, at right angles to the direction of printing. Thus, the measuring method corresponds to the possibilities of setting the ink feed zone by zone in a printing press. However, it is also possible to use the process in presses that have so-called zone-free inking systems.

Figure 4:
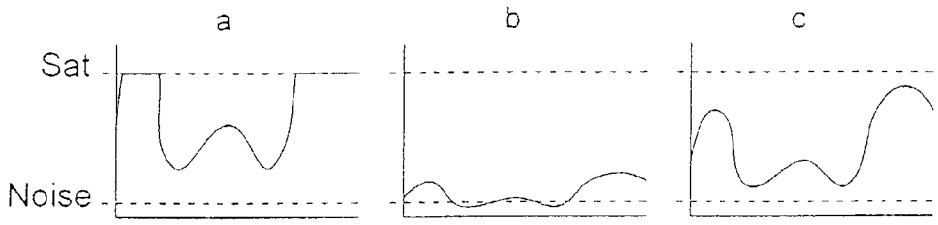
FIG. 4*a* is an example for a spectral measurement showing saturation (Sat) of the photosensitive element.
FIG. 4*b* is an example for a spectral measurement showing the amount of light must too low so as not to reach a high ratio of the measured signal to noise of the detector.
FIG. 4*c* is an example for a spectral measurement showing the measurement selected to be such that a maximum is located in the spectrum just below the saturation limit of the detector.

FIG. 4 shows examples for spectral measurements.

Each detector has an ideal working range. On the one hand, the incident radiation energy must not be too high so as not to bring about saturation Sat of the photosensitive element FIG. 4*a*, but, on the other hand, the amount of light must not be too low FIG. 4*b* so as not to reach a high ratio of the measured signal to noise of the detector. The strongest signal that can be measured during the remission measurement occurs when the white color of the paper is measured. A measurement of the whiteness of the paper may occur, e.g., during the pulling in of the web. Another possibility is to position the measuring head over the normally unprinted edge strip next to the printing area or between the individual pages, where the width of the measuring field function must be taken into account.

The time during which a measuring operation leads to the saturation of the defector varies depending on the light source. By performing one or more test measurements, the measurement is selected to be such that a maximum is located in the spectrum just below the saturation limit of the detector (FIG. 4*c*), e.g., at 90% of the saturation. The ideal measurement time is thus set. A reference spectrum 1 $R_{ref}=[I_{ref}(\lambda 1), I_{ref}(\lambda 2), I_{ref}(\lambda 3), \ldots I_{ref}(\lambda n)]$ is obtained, which can be used to standardize the subsequent measurements. A standardized spectrum is obtained if the spectral values of a measurement are divided by the corresponding values of the reference spectrum:

$$R_{norm}=[I(\lambda 1)/I_{ref}(\lambda 1), I(\lambda 2)/I_{ref}(\lambda 2), I(\lambda 3)/I_{ref}(\lambda 3), \ldots I(\lambda n)/I_{ref}(\lambda n)].$$

Differences in the spectral sensitivity of the detector and of the light source are compensated by the standardization.

Once the ideal measurement time $T_{ideal}$ has been set, the actual measurement time $T_{real}$ must be determined from the cycle time for one printing operation T.

The cycle time of the printing operation is the duration of one printing operation, i.e., a single-time copying of the print original on the paper web. It is often equal to the duration of the period of one revolution of the printing cylinder in rotary printing presses. This is true especially if exactly one print original, e.g., an offset printing plate, is located on the circumference of the printing cylinder.

The cycle time of the printing operation is also equal to the duration of the period for one revolution of the printing cylinder in rotary printing presses that carry two printing plates one behind another on the circumference of the printing cylinder, as they are used, e.g., for printing newspapers, if the two printing plates carry different images and the printing press is operated in the collect-run production mode.

However, the cycle time may also be different from the duration of the period of one revolution of the printing cylinder. This may happen, e.g., in rotary printing presses used for printing newspapers, which carry two printing plates one behind another on the circumference of the printing cylinder, if the two printing plates carry the same image and the printing presses are operated in the double production mode. The cycle time of the printing operation may be equal to half the duration of the period of one revolution of the printing cylinder.

Consequently, depending on the mode of production, T=U/V and T=0.5*U/V is obtained for the circumference U of the cylinder and the press speed V, respectively. If the press speed is so low that the cycle time for one printing operation T is greater than the ideal measurement time $T_{ideal}$, the measurement should be broken down into a plurality of partial measurements, whose values are subsequently added up. If the cycle time becomes short at high press speeds, the measurement may take place over a multiple of T. In principle, a measurement over a plurality of printing cycles may also be broken down into a plurality of measuring intervals in order to optimize the signal-to-noise ratio of the measuring head: The measurement is performed over K printing cycles and these are broken down into J intervals, where the rational K:J ratio approaches the ratio $T_{ideal}:T_{real}$. The measured value is thus formed from the sum of J measurements. For standardization, the spectrum must be divided by the measurement time $T_{real}$ and, in addition, by the reference spectrum.

It is thus achieved that the measuring head always operates in a favorable range.

The regulation of the ink density is used on the integral measurement of the remission spectrum, as was described above, or on an integral, densitometric measurement of the web. The necessary actual values are obtained as a result.

The set points are determined in the process according to the present invention for regulating the ink density from the separated pixel data, which are available after the reduction to half-tones of the original to be printed at the digital preliminary printing stage, or they are taken over from the actual values of printed pages considered to be good.

A method for calculating remission spectra was described by Hübler [HUB]. The scattering behavior of the substrate and the effect of the ink layers applied are taken into account here. The requirement for the calculation of the local remission spectra is that the different colors are transferred to the substrate without register error. To ensure this, it is possible to use a corresponding regulating system. Another possibility is the use of so-called satellite printing units, which have only small register errors due to their design.

What is novel in the basic idea of the process according to the present invention is that what are used as set points are not the local remission spectra, but the integral is determined over columns of the image in the direction of the press in this case as well. In addition, the measuring field function of the measuring head is taken into account in the calculation of the set points. The calculation of set points is performed, e.g., in two steps. The sum of all remission spectra of the pixels that form one column is formed from the separated pixel data reduced to half-tones in the first step, the scattering behavior in the paper and consequently the color of the pixels in the environment of a scattering radius having to be taken into account. An integral remission spectrum is thus obtained for each column of pixels. A column of pixels corresponds to a position X at right angles to the direction of the press. The result is a spectrum S as a function of the position X:

$$S:X\rightarrow\rho, X\mapsto S(x),$$

in which $X\epsilon[0,b]$ is the lateral measurement position on a web of width b and p is the mathematical space of the remission spectra that agree with the spectra obtained during a measurement in terms of the spectral range and the number of support points per spectrum. The function S will hereinafter be called the spectral sum function.

The measuring field function of the measuring head is taken into account in a second step. To do so, the measuring field function Ψ is folded with the spectral sum function S. A set point T is obtained for each position X as a result of this folding:

$$T(X) = (S * \Phi)(X) = \int_{-Bx/2}^{Bx/2} \Phi(\xi) \cdot S(X + \xi) d\xi$$

The regulation of the ink density is based on the comparison of the set points TX with the measured values RX.

Different printing colors differ precisely in that they absorb the radiations of different spectral ranges at different intensities. For example, the long-wave spectral range of the visible light is absorbed by cyan, whereas it is transparent to the printing color magenta. By narrowing the spectrum to certain ranges, color separations of the printed image can be obtained. This applies to both a measurement of the color and the precalculation of the set point from image data. If it is desirable to obtain information concerning a certain color, it is advantageous to measure at a location X at which this color is present and at which the corresponding color separation of the set value function TX has a flat shape. In ranges in which TX has an irregular shape, there is a risk that a small error in the positioning of the measuring head leads to a great error of measurement.

Figure 5:
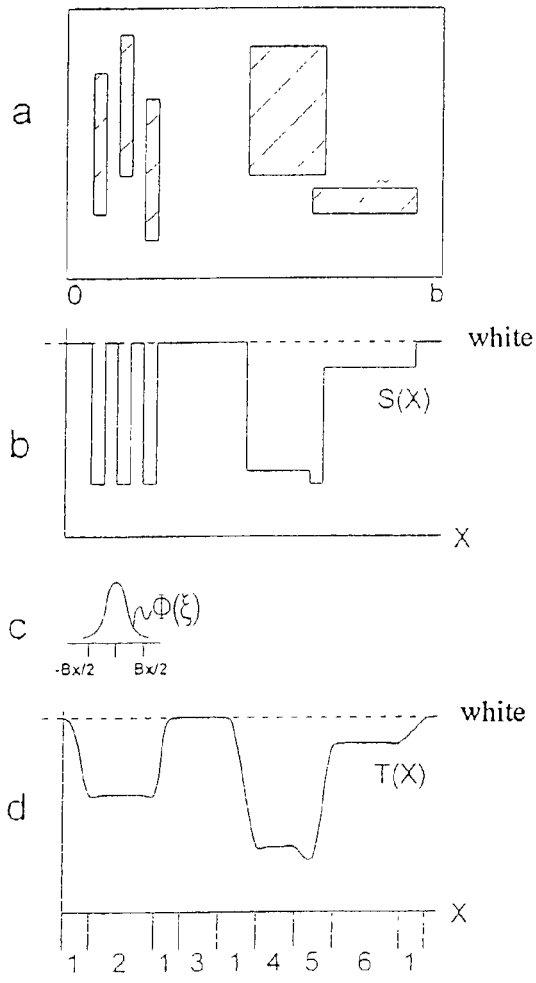
FIG. 5*a* is a schematic view of an example of a printed image showing the areas covered by ink.
FIG. 5*b* is a graph showing the spectrum sum function S(X), which is obtained from the ink coverage.
FIG. 5*c* is a graph showing the measuring field function $\Psi$, which arises from the properties of the measuring head and its positioning in relation to the web.
FIG. 5*d* is a graph showing the set point function T(X), which is formed by folding S with $\Psi$.

FIG. 5 shows a schematic example of a printed image and the generation of the set point function.

FIG. 5*a* shows the areas covered by ink.

FIG. 5*b* shows the spectrum sum function SX, which is obtained from the ink coverage.

FIG. 5*c* shows the measuring field function Ψ, which arises from the properties of the measuring head and its positioning in relation to the web.

FIG. 5*d* shows the set point function TX, which is formed by folding S with Ψ. It corresponds, in principle, to a smoothened spectral sum function. An analysis of TX permits favorable measuring locations to be set. There are ranges 1 in which TX displays great variations. The placement of the measuring head is critical here, and these measuring locations should therefore be possibly avoided. Furthermore, there is a range 2 in which the set point function has a uniform shape, even though the spectral sum function T is still subject to great variations. This uniformly can be attributed to the smoothening, which arises from the folding with the measuring field function. This circumstance contributes to the fact that, e.g., the measurement of print areas reduced to half-tones is possible if the width of the measuring field exceeds the grid width. Even though ranges without printing ink 3 show a uniform shape of the set point, they are unsuitable for the color measurement. The measured values are at their maxima, and they correspond to the reference measurement of the whiteness of the paper. Locations with high ink take-off 4 are, in principle, best suited for carrying out accurate color measurements. However, there may also be ranges 5 even here in which the set points vary with the position, which reduces the suitability of these locations for the measurement. Measurement is also possible in ranges of uniform, slight ink take-off 6.

The accuracy of positioning of the measuring head should be advantageously more accurate than the width of the measuring width. The width of the measuring field should also be greater than the possible lateral displacements of the printed web in order to avoid errors in measurement that may arise from the relative positioning error between the measuring head and the web.

There are a large number of parameters that affect the color reproduction, especially in web offset. A good starting point can be created as a basis for the regulation if the printing press is set correctly and especially the position of the rollers of the inking system and the damping system can be kept constant. The production processes of the preliminary stage should also be standardized, especially the production of the plates. Furthermore, the printing press should make possible printing true to register, because register errors lead to color shifts, which cannot be compensated by the adjustment of the ink and water feed. Satellite printing units are suitable for this, or, e.g., presses of the so-called eight-up tower configuration, if measures are taken to compensate the stretching of the paper. Without such a starting point, on-line regulation of the ink density is unthinkable anyway, because errors in the preliminary printing stage can be compensated during printing to a low extent only, or presses with poor roller position or a high register inaccuracy are not suitable for quality printing anyway, for which the use of an ink density regulator is desirable.

If the requirements are met on the part of the preliminary printing stage and the printing press, it is sufficient to use the zone-by-zone ink feed and the damping agent feed for ink density regulation as final control elements of the control circuit.

The dynamics of a conventional gap inking system are complex and depend on the number, type and arrangement of the rollers used. However, it can be stated, in general, that the higher the ink take-off, the more rapidly adjustments on the ink management will become visible in the printed image. At low ink take-off, the adjustments become effective more slowly. The ink take-off varying at right angles to the direction of the press is taken into account by zone-by-zone ink feed. Traversing rollers ensure the lateral distribution of the ink. The correct setting of the zones becomes important at high ink take-off, while the zones become rather "blurred" at low ink take-off, because the macroscopic ink transport takes place more slowly in the direction of the press and the traversing rollers bring about a more intense lateral spreading of the ink.

The damping agent feed also affects the color reproduction, and there also is a dependence on surface coverage. If the amount of damping agent feed is too small, "toning" occurs, i.e., ink is transferred to nonprinting areas of the printing form. If the amount of damping agent feed is too large, there is a risk of "emulsification" of the ink, especially in the case of low ink take-off, which leads to uncontrollable phenomena. The damping agent feed is often set over the width of the page, but it may also be carried out zone by zone, but usually only a small number of zones are formed in this case.

According to one control strategy of the regulating process according to the present invention, a set of weighting parameters, according to which an adjustment of the ink screws or an adjustment of the damping agent feed is carried out, is determined depending on the zone-by-zone ink take-off of the individual printing inks and their respective overall ink take-off. By performing measurements at a plurality of points, it is possible to decide whether the damping agent feed or the ink feed must be set or whether a weighted adjustment of both manipulated variables is necessary.

The order of the measuring locations and the frequency with which measurements are performed at the respective measuring locations should also be selected as a function of the image according to the present invention. Locations with high ink take-off should be monitored more frequently, especially at the start of the production; this corresponds to the dynamics of the inking system, because these locations respond to adjustments more quickly. At locations with low ink take-off, the time intervals between two measurements may be longer, but it is advantageous to perform a plurality of measurements at locations with low ink take-off in order to achieve increased accuracy of the measurement by averaging. In fact, the differences to be expected from the reference measurement are small, so that a more accurate measurement becomes necessary than in the case of high ink take-off.

The present invention preferably pertains to web offset printing, especially wet offset, but it is not limited to offset printing, but it may be advantageously used in other printing processes as well. The material web is preferably a paper web as is the case with the especially preferred printing of large newspaper runs. However, in principle, the material of the web does not need to be paper, and the present invention may rather be used wherever high qualitative requirements are imposed on the printing process.

References

WO 96/12934, "On-Press Color Measurement Method with Verification," Runyan, S. et al., Graphics Microsystems, Inc., Oct. 19, 1995.

Offenlegungsschrift DE 198 22 662 A1, "Image Data-Oriented Printing Press and Process for Operating the Image Data-Oriented Printing Press," Dilling, P., MAN Roland Druckmaschinen AG, Nov. 25, 1999.

[HUB] Hübler, A. C., "Structure of the Radiation Process in Autotype Half-tone Printed Images," Dissertation at the Institut für Technologie und Planung Druck, Berlin 1992.

While specific embodiments of the invention have been shown and described in detail to illustrate the application of the principles of the invention, it will be understood that the invention may be embodied otherwise without departing from such principles.

What is claimed is:

1. A process for measuring the inking in web printing, comprising the steps of:

providing a measuring head or a plurality of measuring heads; and performing an integrating measurement of the light remitted by a printed material web in the direction of run of the material web using the measuring head or a plurality of measuring heads, wherein the measurement of the whiteness of the paper is carried out at the unprinted edge of the paper web and/or in the unprinted areas between the pages.

2. A process in accordance with claim 1, wherein the measuring head can be positioned at right angles to the direction of run of the web.

3. A process in accordance with claim 1, wherein a duration of the measurement corresponds to the cycle time of the printing operation or to a multiple of the cycle time of the printing operation.

4. A process in accordance with claim 1, wherein the measurement is carried out by recording a remission spectrum of the running web or by adding up a plurality of consecutive remission spectra of the running web.

5. A process in accordance with claim 1, wherein the measurement is a densitometric measurement or comprises a densitometric measurement of the running paper web or a plurality of consecutive densitometric measurements of the running paper web are added up.

6. A process in accordance with claim 1, wherein a standardization of the measurement is performed by the steps of:

dividing measured values by reference values and dividing the measured values by a measurement time; and multiplying them the measured values by a reference time.

7. A process in accordance with claim 1, wherein reference values are determined by a measurement of the whiteness of the paper, a measurement time is selected to be such that a dynamic range of the measuring head is extensively exhausted without being exceeded, wherein the reference time is the measurement time of this reference measurement.

8. A process in accordance with claim 1, wherein reference values and a reference time are stored in a data storage unit and are loaded for similar productions.

9. A device for measuring the inking in web priming, the device comprising:

a measuring bead or a plurality of measuring heads provided for measuring including performing an integrating measurement of the light remitted by a printed material web using the measuring head or the plurality of measuring heads in the direction of run of the material web;

a sensor element for receiving light that is remitted by a running, printed web of material;

an adding or integrating means, which is connected to a sensor element, of which there is at least one, in order to determine the intensity of the light received; and a control, which presets the duration of reception of light and/or the duration of the addition or integration by means of the adding or integrating means for an adding or integrating intensity measurement of the remitted light in the direction of run of the web.

10. A device in accordance with claim 9, wherein a plurality of sensor elements including said sensor element cooperate to form a spectrometer.

11. A device in accordance with claim 9, wherein the control presets not only the duration of an integrating measurement, but also the duration between two consecutive integrating measurements as a function of the velocity of the running web.

12. A device according to claim 12 wherein the control calculates set points from an image data.

13. A device for regulating the ink density in web offset printing in accordance with claim 12, further comprising ink feed adjusting elements for a zone-by-zone ink feed adjustment.

14. A device for regulating the ink density in web offset printing in accordance with claim 12, wherein only the ink feed over the width of the zone is adjusted.

15. A device for regulating the ink density in web offset printing in accordance with claim 12, wherein the adjusting elements for adjusting the ink feed over the width of the zone are ink screws, which act on a doctor knife bar.

16. A device for regulating the ink density in web offset printing in accordance with claim 12, wherein the damping agent feed over the width of the zone is adjusted.

17. A process comprising:

providing a measuring head or a plurality of measuring heads; and performing an integrating measurement of the light remitted by a printed material web in the direction of run of the material web using the measuring head or a plurality of measuring heads;

calculating set points from an image data, fanning integrals of a remission spectrum over the columns of the image and folding these with a measuring field function of a measuring head, or forming set points from the measured actual values of pages that are considered to be good; and setting an ink density in web printing by setting the ink feed or the damping agent feed.

18. A process in accordance with claim 17, wherein favorable measuring locations are determined from the image data, the number of measuring locations is determined in an image-dependent manner and the order and the frequency at which a measuring head performs a measurement at a measuring location are determined in an image-dependent manner.

19. A process in accordance with claim 17, wherein the image data are the separated and reduced-to-half-tone data sets for the individual printing inks.

20. A process in accordance with claim 17, wherein measuring locations are preferably performed at locations at which the set point function or a color separation of the set point function has a flat shape.

21. A process in accordance with claim 17, wherein measurement is performed frequently at locations of high ink take-off and it is performed less frequently at locations of low ink take-off, but a plurality of measurements are performed at of low ink take-of and these measurements are averaged.

22. A process in accordance with claim 17, wherein weighting parameters are formed for the final control elements in an image-dependent manner, on the basis of which the final control elements are selected for corrections.

* * * * *